United States Patent [19]

Leifeld

[11] 4,213,553

[45] Jul. 22, 1980

[54] WEB GUIDING DEVICE

[75] Inventor: Ferdinand Leifeld, Kempen, Fed. Rep. of Germany

[73] Assignee: Trützschler GmbH & Co. KG, Mönchen-Gladbach, Fed. Rep. of Germany

[21] Appl. No.: 938,330

[22] Filed: Aug. 30, 1978

[30] Foreign Application Priority Data

Sep. 13, 1977 [DE] Fed. Rep. of Germany ..... 2741095

[51] Int. Cl.[2] ..... B65H 23/04; G03B 1/48

[52] U.S. Cl. ..... 226/196; 242/54.4

[58] Field of Search ..... 242/54.4, 157 R; 226/196, 181; 19/150, 155, 157, 159 R, 288, 289

[56] References Cited

U.S. PATENT DOCUMENTS 3,362,049 1/1968 Kiser ..... 19/288

3,432,891 3/1969 West ..... 19/157

FOREIGN PATENT DOCUMENTS 122870 8/1901 Fed. Rep. of Germany ..... 242/54.4

*Primary Examiner*—Leonard D. Christian

*Attorney, Agent, or Firm*—Spencer & Kaye

[57] ABSTRACT

A device for withdrawing and gathering a fiber web discharged by a web delivering assembly includes a guide element arranged downstream of the web delivering assembly as viewed in the direction of web advance and a trumpet arranged downstream of the guide element. The guide element has an outlet opening through which the web leaves the guide element. The trumpet is positioned immediately at the outlet opening as the continuation thereof, so that the web can pass directly from the guide element into the trumpet.

10 Claims, 4 Drawing Figures

WEB GUIDING DEVICE

BACKGROUND OF THE INVENTION

This invention relates to a device for withdrawing and gathering a fiber web from a web delivering assembly of a carding machine and is an improvement of the device described in U.S. patent application Ser. No. 887,215, filed Mar. 16th, 1978. The web guiding device described therein has a guide element and a sliver trumpet arranged, together with calender rolls, downstream of the guide element as viewed in the direction of web travel. The web gathered by the guide element is led about a rounded lateral edge of the guide element and is caused by the trumpet to converge to form a sliver. It is a disadvantage of this arrangement that air currents may freely impinge on the running gathered web in the space between the guide element and the trumpet and may adversely affect the running web. Such a difficulty is encountered particularly in case the gathered web exits the guide element at high speeds.

SUMMARY OF THE INVENTION

It is an object of the invention to provide an improved web guiding device from which the effect of air on the running gathered web which has left the guide element is eliminated and which permits high running speeds.

This object and others to become apparent as the specification progresses, are accomplished by the invention, according to which, briefly stated, the device for withdrawing and gathering a fiber web discharged by a web delivering assembly includes a guide element arranged downstream of the web delivering assembly as viewed in the direction of web advance and a trumpet arranged downstream of the guide element. The guide element has an outlet opening through which the web leaves the guide element. The trumpet is positioned immediately at the outlet opening as the continuation thereof, so that the web can pass directly from the guide element into the trumpet.

By virtue of the arrangement according to the invention, the distance between the trumpet and the guide element can practically be reduced to zero so that no air can impinge on the gathered web. The gathered web thus is capable of running at high speeds without the danger of "flutter". Since the trumpet adjoins immediately the guide element, the web passes directly from the guide element into the trumpet.

Expediently, the trumpet is fixedly secured to the guide element as the continuation thereof; the guide element and the trumpet may even be a one-piece member made, for example, by deep-drawing.

According to another feature of the invention, the guide element, the trumpet and the calender rolls are displaceable as a structural unit with respect to the rolls (such as crush rolls) of the web delivering assembly. Thus, during operation, it is feasible to move the structural unit away from the crush rolls of the web delivering assembly either for the purpose of observing the web emerging from the web delivering assembly or for eliminating operational disturbances. Further, this arrangement facilitates start-up during which the web discharged by the crush rolls is first manually gathered and introduced into the trumpet.

According to another embodiment, the trumpet and the calender rolls are displaceable with respect to the guide element. In this manner both the guide element and the trumpet with the calender rolls can be shifted independently from one another. The displacement of the trumpet with the calender rolls alone or together with a structurally unitary guide element may be effected by shifting, turning, pivoting or swinging about a horizontal axis upwardly or downwardly.

DETAILED DESCRIPTION OF THE PREFERRED EMBODIMENTS

Figure 1:
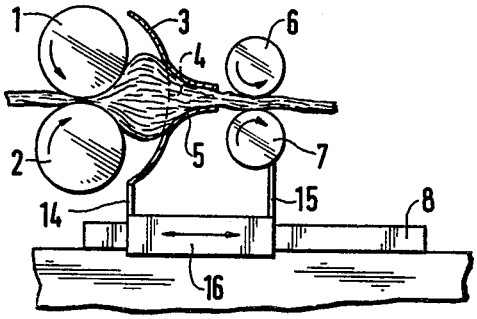
FIGS. 1 and 2 are schematic side elevational views of two preferred embodiments of the invention.

Turning now to FIG. 1, there are shown cooperating rolls 1 and 2 of a web delivering assembly arranged downstream of a card (not shown) and a concave guide element 3 which is arranged immediately downstream of the rolls 1 and 2. The opening 4 of the guide element 3 is shaped to immediately continue as a sliver trumpet 5, downstream of which there are arranged two calender rolls 6 and 7. The trumpet 5 and the calender rolls 6 and 7 form a calender assembly which, as a structural unit, is, together with the guide element 3, shiftable parallel to the direction of web advance. For this purpose, the calender assembly 5, 6 and 7 as well as the guide element 3 are secured by means of two posts 14 and 15 to a slide 16 which is horizontally displaceably mounted on a track 8.

Figure 2:
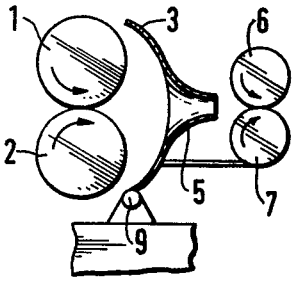

Turning now to the embodiment illustrated in FIG. 2, the guide element 3 as well as the trumpet 5 together with the calender rolls 6 and 7 are, as a structural unit, supported at 9 to be pivotal about a horizontal axis from the position shown in FIG. 2 clockwise into a downward direction.

Figure 3:
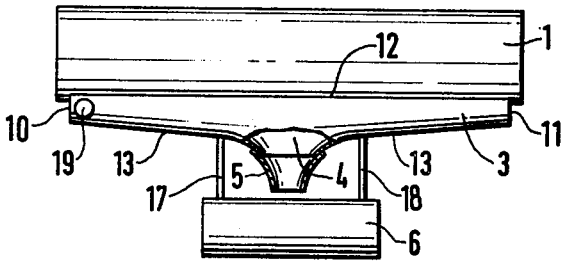
FIG. 3 is a schematic top plan view of still another preferred embodiment of the invention.

Turning now to FIG. 3, there is shown a guide element 3 which has a centrally arranged circular outlet opening 4 situated between the lateral edges 10 and 11 of the guide element and having a rounded edge. The trumpet 5 is a separate component and is mounted directly on the outlet opening 4. The guide element 3 immediately adjoins the rolls of the web delivering assembly (only roll 1 is visible) in such a manner that no air current may affect the gathered web. The guide element 3 shrouds both rolls 1 and 2 of the web delivering assembly in the vertical direction (see FIG. 1) as well as in the horizontal direction. The horizontal longitudinal upper edge 12 and the horizontal lower edge (not visible in FIG. 3) of the guide element 3 extend, in the closed operational position as shown in FIG. 3, very closely to the surface of the respective rolls 1 and 2 and are parallel to the roll axes. The guide faces 13 of the guide element 3 are slightly conical for enhancing the introduction of the web into the trumpet 5. The lateral edges 10 and 11 of the guide element 3 are at least substantially flush with the lateral end faces of the rolls 1 and 2, so that the entire web discharged by the rolls 1 and 2 is taken-in by the guide element 3. The latter is connected by means of two holders 17 and 18 with the calender roll pair. In the zone of the outer lateral edge 10 there is provided a hinge element 19 which is mounted on a fixed machine part and by means of which the guide element 3, the trumpet 5 mounted on the guide element 3 as well as the calender rolls 6 and 7 connected with the guide element 3 can pivot about a vertical axis from the closed position shown in FIG. 3 into an open position away from the rolls 1 and 2.

Figure 4:
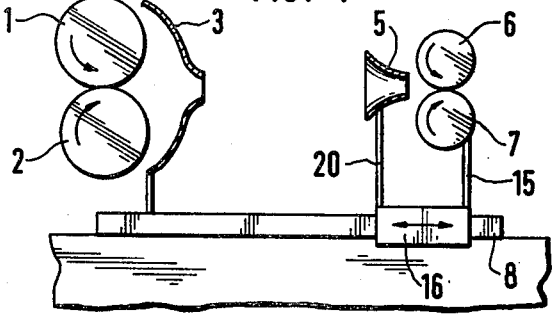
FIG. 4 is a schematic side elevational view of a further preferred embodiment of the invention.

Turning now to FIG. 4 there is illustrated a further embodiment in which the guide element 3 is mounted immediately at the rolls 1 and 2. Downstream of the guide element 3 there is arranged the structurally unitary calender assembly formed of the trumpet 5 and the calender rolls 6 and 7. The trumpet 5 and the calender rolls 6 and 7 are connected with a slide 16 by means of posts 20 and 15, respectively. The slide 16 is displaceable on the track 8 to thus permit a horizontal displacement of the calender assembly with respect to and independently from the guide element 3. It is feasible to modify this embodiment by displaceably securing the track 8 on its support to provide a displaceability also of the guide element 3 with respect to the rolls 1 and 2.

It is to be understood that the above description of the present invention is susceptible to various modifications, changes and adaptations, and the same are intended to be comprehended within the meaning and range of equivalents of the appended claims.

What is claimed is:

1. In a device for withdrawing and gathering a fiber web discharged by a web delivering assembly; the device including a guide element arranged downstream of the web delivering assembly as viewed in the direction of web advance and having an outlet opening through which the web leaves the guide element; a trumpet arranged downstream of the guide element; and a calender roller pair arranged downstream of the trumpet and forming a calender assembly with said trumpet; the improvement comprising means for displaceably supporting said trumpet, said roller pair and said guide element for movement as a unitary structure with respect to said web delivering assembly.

2. A device as defined in claim 1, wherein said trumpet is positioned immediately at said outlet opening in a bordering relationship therewith.

3. A device as defined in claim 2, wherein said trumpet being affixed to said guide element and is a continuation of a guiding face thereof.

4. In a device for withdrawing and gathering a fiber web discharged by a web delivering assembly; the device including a guide element arranged downstream of the web delivering assembly as viewed in the direction of web advance and having an outlet opening through which the web leaves the guide element; a trumpet arranged downstream of the guide element; and a calender roller pair arranged downstream of said trumpet and forming a calender assembly with said trumpet; the improvement comprising means for displaceably supporting said calender assembly with respect to said guide element.

5. In a device for withdrawing and gathering a fiber web discharged by a web delivering assembly; the device including a guide element arranged downstream of the web delivering assembly as viewed in the direction of web advance and having an outlet opening through which the web leaves the guide element; a trumpet arranged downstream of the guide element; and a calender roller pair arranged downstream of said trumpet and forming a calender assembly with said trumpet; the improvement comprising means for displaceably supporting said calender assembly with respect to said web delivering assembly.

6. A device as defined in claim 5, wherein said means comprises means for horizontally shifting said calender assembly.

7. A device as defined in claim 5, wherein said means comprises means for displacing said calender assembly with respect to said guide element.

8. A device as defined in claim 5, wherein said means comprises means for pivotally supporting said calender assembly for motion about an axis.

9. A device as defined in claim 8, wherein said axis is horizontal.

10. A device as defined in claim 8, wherein said axis is vertical.

* * * * *